United States Patent [19]

Zunkel

[11] 4,050,114

[45] Sept. 27, 1977

[54] DOOR CLOSER ASSEMBLY

[75] Inventor: Richard L. Zunkel, Marshville, N.C.

[73] Assignee: Eaton Corporation, Cleveland, Ohio

[21] Appl. No.: 718,493

[22] Filed: Aug. 30, 1976

[51] Int. Cl.[2] ..... E05F 15/20

[52] U.S. Cl. ..... 16/48.5; 16/51; 251/141

[58] Field of Search ..... 16/48.5, 49.5, 52, 56, 16/58, 66, 84, DIG. 9, 21; 251/141

[56] References Cited

U.S. PATENT DOCUMENTS

| | | | |
|---|---|---|---|
| 3,574,886 | 4/1971 | Solovieff | 16/51 |
| 3,852,846 | 12/1974 | Slaybaugh | 16/48.5 |
| 3,964,125 | 6/1976 | Tansley | 16/48.5 |

*Primary Examiner*—Ronald Feldbaum
*Attorney, Agent, or Firm*—Teagno & Toddy

[57] ABSTRACT

A door closer hold open assembly connectable to a door for closing a held open door in response to a control signal includes a housing, a linkage assembly connectable to the door, biasing means providing a restoring force to move the door to the closed position and a main piston assembly disposed in the housing and actuatable by the linkage to move the main piston against the force of the biasing means. A fluid chamber is disposed in the housing for exerting a force on the main piston to balance the force of the biasing means in a desired door position to maintain the main piston and the door in the position it was last moved to by the linkage assembly. First and second independently operable valve means are disposed in a parallel circuit and are operable to control the flow of fluid from the chamber. The first valve means is electrically controlled from a closed position to an open position and the second valve means is resiliently biased toward a closed position. The second valve means is operable upon the fluid in the chamber reaching a predetermined pressure to open against the resilient biasing force and provide for fluid flow therethrough from the chamber. The fluid in the chamber exerts a biasing force on the first valve means when the first valve means is in its closed position to bias the first valve means toward the closed position.

23 Claims, 4 Drawing Figures

DOOR CLOSER ASSEMBLY

FIELD OF THE INVENTION

Background of the Invention

This invention relates to door closer assemblies generally and more particularly to door closers which operate in response to an electrical control signal to automatically close a door.

Description of the Prior Art

As a safety feature in building construction it is highly desirable to have a door closing system which will automatically close the building doors during an emergency situation such as one involving smoke and fire. The spread of the smoke and fire to other parts of the building is thereby minimized by isolating the smoke and fire to the area between certain closed doors. However, during non-emergency situations it is desirable to maintain a speedy pedestrian traffic flow throughout the building and it is also desirable, therefore, to have means for maintaining the building doors in an open position from which the doors may also be manually closed when necessary.

Door closers are known which automatically close doors upon detecting the presence or absence of an electrical signal. An example of such a door closer may be seen in U.S. Pat. No. 3,771,823 issued to Raymond H. Schnarr. This door closer utilizes a latch device which is engaged in a locking position by an energized solenoid to maintain a door open. When the electrical signal to the solenoid is discontinued, the latch is disengaged and the door is allowed to close. U.S. Pat. No. 3,777,423 issued to Gordon L. Coulter and U.S. Pat. No. 3,696,462 issued to Paul W. Martin provide other examples of such door closers. Such systems are deficient in that the door is maintained open in only the predetermined latching positions.

Hydraulic door operators are also known which open and close doors in response to electrical signals originating from control centers such as doormats. An example of such operators is found in U.S. Pat. No. 3,003,317 issued to Charles S. Schroeder. The Slaybaugh U.S. Pat. No. 3,852,846 utilizes complicated porting and valving which complicates the manufacture and thus increases the cost to the end user. Moreover, in closers such as utilized in Slaybaugh a momentary interruption of current to the solenoid will cause the door to close. This presents a problem when electrical storms occur and the power is momentarily interrupted. In the Slaybaugh device the fluid flow and fluid pressure act to push the solenoid valve to an open position. Thus, if the electrical current to the solenoid is momentarily interrupted, the valve will open and not close upon the reapplication of current to the solenoid until the door is fully closed and the fluid pressure acting on the solenoid valve is relieved.

The present invention solves these problems of the prior art devices as well as others by providing a simple and inexpensive door closer which remains open in any position and which starts to close upon the momentary interruption of current thereto and which then stops and remains open when current is reapplied thereto and which is smooth and reliable in operation.

SUMMARY OF THE INVENTION

In a specific adaptation of the present invention, the door closer assembly is connected to a door by a linkage assembly which transmits door movements of the door from the closed position to an open position to the door closer assembly. These door movements cause a main piston assembly to move against a biasing spring which normally acts to return the main piston to its original position and thereby to close the door. The force of the biasing spring is balanced by a secondary piston assembly which counteracts the biasing force of the biasing spring and thus allows the door to remain open in the last opened position of the door. This balancing force of the secondary piston assembly is controllably released by a release mechanism to allow the biasing spring to close the door when such a closing is deemed desirable.

The present invention contemplates a door closer hold open assembly including a housing, a linkage assembly connectable to the door, biasing means providing a restoring force to move the door to the closed position, a main piston assembly disposed in the housing and a fluid chamber in the housing having fluid disposed therein for asserting a force on the main piston to balance the force of the biasing means in any desired door position. Release means are provided for releasing the fluid disposed in the chamber to dissipate the balancing force of the fluid to allow the door to return to the closed position. The release means includes first and second independently operable valve means disposed in a parallel circuit to control the flow of fluid from the chamber. The first valve means is electrically controlled from a closed position prohibiting fluid flow therethrough to an open position providing fluid flow therethrough from the chamber and the second valve means is resiliently biased toward a closed position prohibiting fluid flow therethrough from the chamber. The second valve means is operable upon a predetermined increase in the fluid pressure in the chamber to open against the resilient biasing force and provide for fluid flow therethrough from the chamber to enable the door to close.

Another aspect of the present invention is to provide a door closer hold open assembly which includes a housing, a linkage assembly, biasing means providing a restoring force to move the door to a closed position, a main piston assembly, a fluid chamber disposed in the housing having fluid disposed therein for exerting a force on the main piston to balance the force of the biasing means and release means for releasing the fluid disposed in the chamber to dissipate the balancing force of the fluid and allow the door to return to the closed position under the influence of the biasing means. The release means includes an electrically controlled valve means which has a first valve member, a solenoid energizable for biasing the first valve member toward a closed position preventing fluid flow therethrough from the chamber and second biasing means for biasing the first valve member toward an open position to provide fluid flow therethrough from the chamber. The fluid in the chamber exerts a force on the first valve member when the first valve member is in its closed position to bias the first valve member toward the closed position.

These and other aspects of the present invention will be more readily apparent upon a review of the following description of the preferred embodiment when considered with the drawings.

BRIEF DESCRIPTION OF THE DRAWINGS

FIG. 3 is a cross-sectional view of the door closer assembly illustrated in FIG. 2 with the door closer in the door hold open position.

DESCRIPTION OF THE PREFERRED EMBODIMENT

Figures 1, 2:
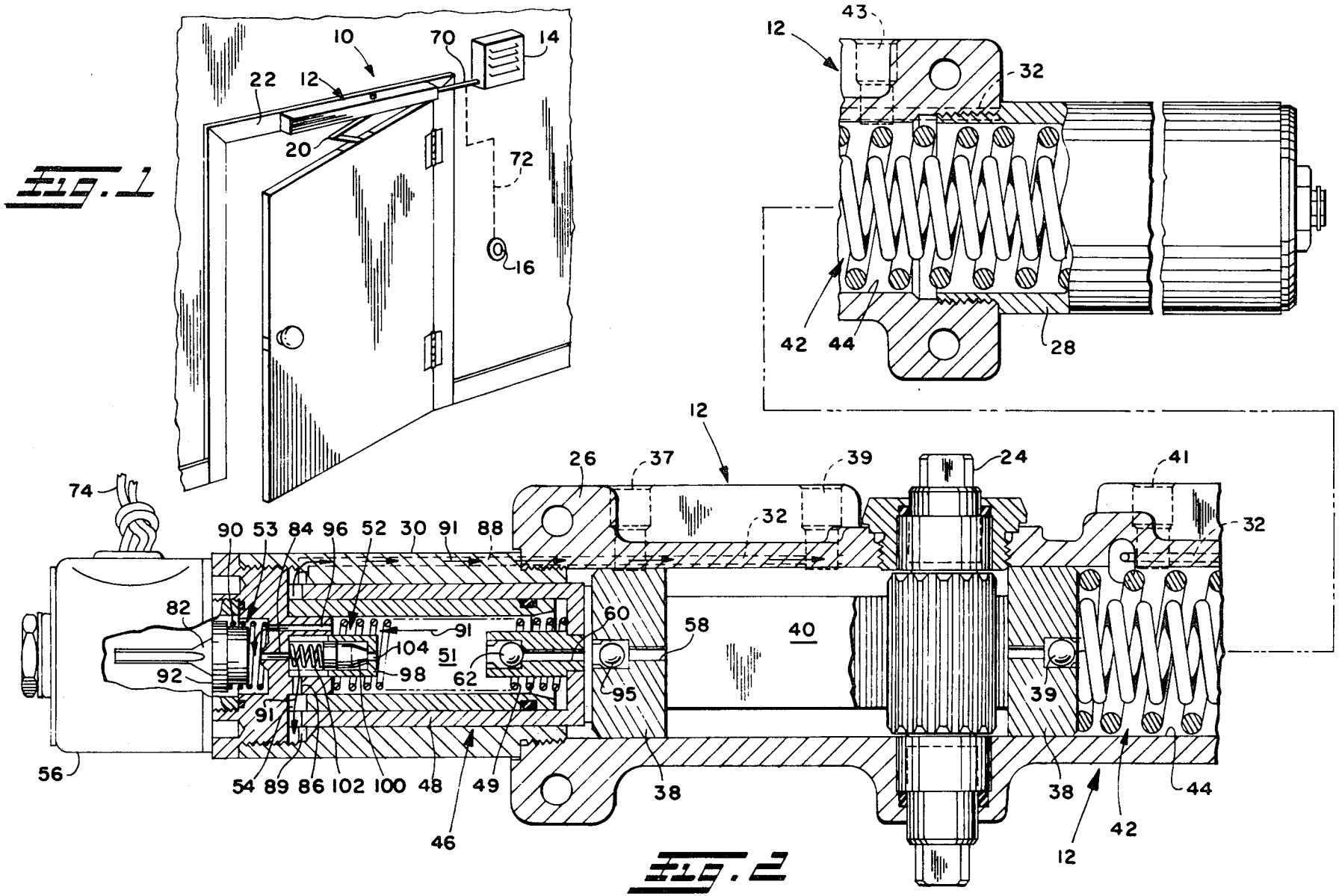
FIG. 1 shows the door closer of the present invention mounted to a door assembly and connected to a device which detects the products of combustion and a current interruption switch.
FIG. 2 is a cross-sectional view of the door closer assembly of the present invention with the door closer in the door closed position.
Figure 5:
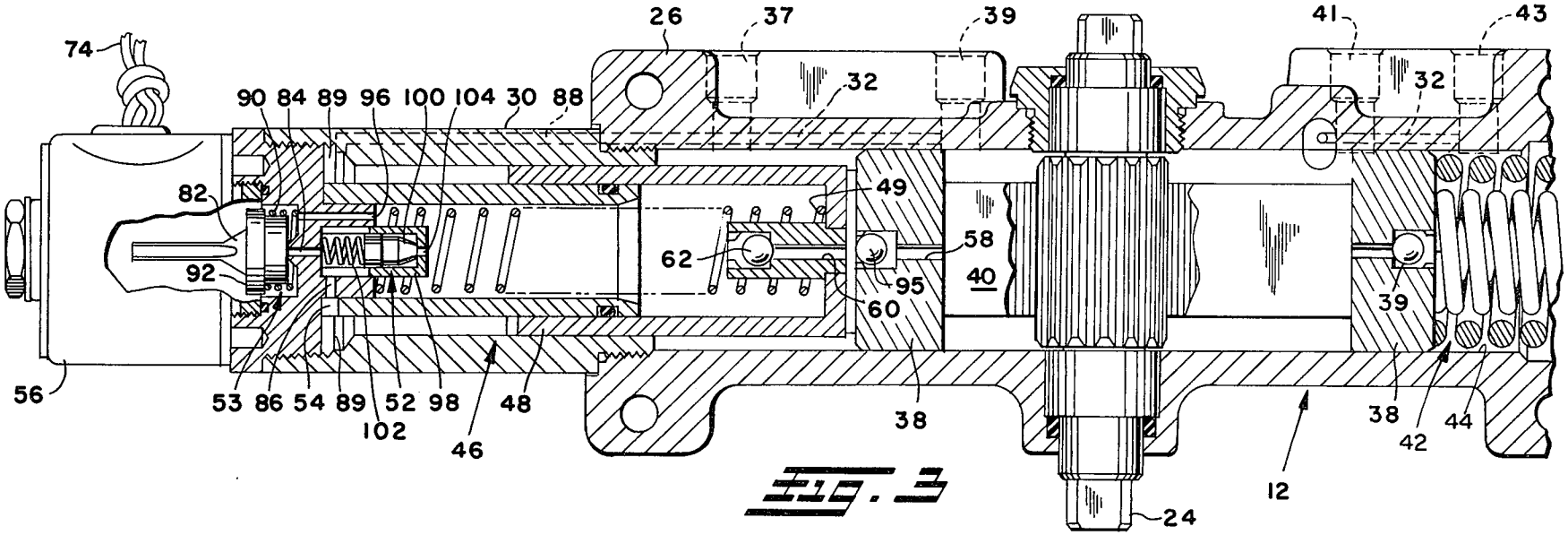

Referring now to the drawings, it will be understood that the showings are to illustrate a particular preferred embodiment of the present invention and are not intended to limit the invention thereto.

The door closing system 10 of the present invention is best seen with reference to FIG. 1 as including a door closer 12, a products of combustion detector 14 and a current interruption switch 16.

This door closing system 10 is used to maintain a door 18 in the position to which it was last opened until a control signal is received from either the detector assembly 14 or the current interruption switch 16. The door 18 may also be manually closed by having a person push on the door 18 with sufficient force to initially overcome the retaining force of the door closer 12. After the force is overcome and the door 18 starts to close the door closer 12 will automatically close the door 18 the remainder of the way. The door closer assembly 12 is shown mounted to a top jamb 22 of the door 18 but may also be mounted to the door 18. The door closer 12 senses the movement of the door 18 through the movement of a linkage 20 which may be affixed either to the door jamb 22 or the door 18 at one end and a pinion shaft 24 of the door closer 12 at the other end depending upon the mounting of the door closer assembly 12.

Turning now to FIG. 2 it will be appreciated that the door closer assembly 12 has a main body section 26 into the ends of which secondary body sections 28 and 30 are sealably threaded. These body sections 26,28 and 30 have formed therein a selective porting passageway 32 which provides selective fluid communication between the secondary body section 30 and the main body section 26 and between the main body 26 and the secondary body 28 depending upon whether the door is being opened or closed. The selective porting passageway 32 also prevents the flow of fluid between the main body 26 and the secondary bodies 28 and 30 to maintain the door 18 open until the occurrence of a predetermined condition. The speed of closing the door 18, is controlled by valves 37,39 and the opening speed is controlled by valves 41,43, as will be explained later.

Turning back to FIG. 2 it will be seen that a main piston 38 is sealably located within the main body 26 to form a main piston or fluid chamber 40 therein. The main piston 38 is connected to the pinion 24 by a rack and pinion arrangement, familiar to those skilled in the art, which moves the piston 38 in response to rotation of the pinion 24. The main piston 38 is shown in the door closed position in FIG. 2 and as the door 18 is opened, the linkage 20 rotates the pinion 24 causing the piston to move to the right against a return spring assembly 42 sealably located within the secondary body 28 which forms a spring chamber 44. As the main piston 38 moves to the right by the opening of the door 18 to its door open position illustrated in FIG. 3, the spring assembly 42 is compressed to provide a restoring force acting against the main piston 38. At the same time fluid is evacuated from the spring chamber 44 through valves 41 and 43 by way of the selective porting passageway 32 to valve 39 which directs the fluid to the main fluid chamber 40. The selective porting passageway 32 provides fluid communication between the valves 37,39,41 and 43 and their associated fluid chambers. To this end the selective porting passageway 32 includes a passageway, not illustrated, which passes through the body 26 around the pinion 24 to connect the selective porting passageway 32 associated with valves 37 and 39 to the selective porting passageway 32 associated with valves 41 and 43. Return flow to the spring chamber 44 is prevented by a check valve 39 which closes in response to the fluid pressure established in spring chamber 44 and the fluid is then communicated to the secondary chamber 50 as will be described more fully hereinafter. The ease and speed with which the door 18 is opened is controlled by the adjustable valves 41 and 43 which restrict the flow of fluid from the spring chamber 44 to the main chamber 40. To maintain the door 18 in the open position a counterbalancing force is provided to negate the restoring force of the spring assembly 42 on the main piston 38 by a counterbalancing assembly 46 mounted withn the secondary body 30.

Figure 4:
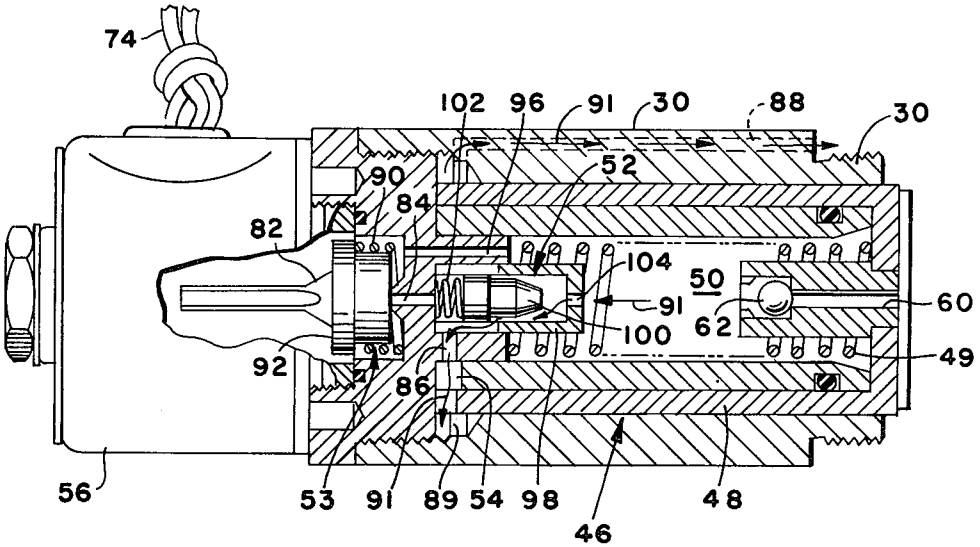
FIG. 4 is an expanded view of the actuator end of the door closer of FIG. 2 illustrating the valving in an overriding position.

As may be best seen with particular reference to FIGS. 2, 3 and 4, the counterbalancing assembly 46 includes a secondary piston 48 which is mounted within the secondary body 30 to sealably move therein and provide a chamber 50 which is either pressurized or vented depending upon the position of sealing valves 52,53. The secondary piston 48 is biased by a spring 49 which allows the secondary piston 48 to follow the main piston 38. The sealing valve 52,53 either blocks or unblocks a vent passageway 54 in response to the energized or unenergized state of a solenoid 56 to either block or open fluid flow from the chamber 50 to the main fluid chamber 40 through the porting 32.

The sealing valve 52 includes a solenoid controlled valve member 82 which is moved to its closed position as is illustrated in FIG. 4, upon energization of the solenoid 56. The valve member 82 controls the fluid flow from the chamber 50 to the main piston chamber 40. To this end, a passageway 96 provides fluid communication between the chamber 50 and the valve member 82. The valve member 82 then controls fluid flow from the chamber 50 through the passageway 84 which communicates with passageways 86 and 54. The fluid flows from passageway 54 into an annular chamber 89 which communicates with a passageway 88 which hs one end connected to the selected porting passageway 32. The selected porting passageway 32 then acts to direct fluid therethrough from chamber 50 to the main fluid chamber 40. Thus, opening of valve 53 provides for fluid flow in the direction of arrows 91 from chamber 50 through passageways 96,84,86,54,89,88 and 32 to the main fluid chamber 40. A spring means 90 is provided to bias the valve member 82 toward its open position. When the valve member 82 is in its closed position the fluid pressure established in chamber 50 is transferred through the passageway 96 to act on the rear surface 92 of the valve member 82. Thus, the fluid pressure in chamber 50 acts to bias valve member 82 toward its closed position as is illustrated in FIG. 4 when valve member 82 is in its closed position.

The secondary sealing valve 53 includes a valve guide member 98 and a valve member 100. A passageway 104 is formed in the guide member 98 to enable the valve member 100 to control the fluid flow therethrough from the chamber 50 through tha passageways 86,54,89,88 and 32 to the main fluid chamber 40. A spring 102 is provided to bias the valve member 100 toward its closed position. The fluid in chamber 50 acts on the valve member 100 to bias the valve member 100 toward its opened position. When the fluid pressure in chamber 50 reaches a predetermined value the spring force of spring 102 will be overcome and the valve member 100 will move to its open position as is illustrated in FIG. 4 to allow fluid flow through the passageway 104 and through the passageways 86,54,89,88 and 32 to the main fluid chamber 40.

The secondary piston 48 follows the movement of the main piston 38 when the sealing valves 52,53 block fluid flow through the passage 54. As the main piston 38 moves in response to the opening of the door, the fluid is exhausted to the main fluid chamber 40 from the spring chamber 44 through the valves 41,43 and passageway 32. The fluid then flows from the main fluid chamber 40 through a passageway 58 and through check valve 95 to a communicating passageway 60 disposed in the secondary piston 48. The flow forces oepn a ball check valve 62 disposed at one end of passageway 60 to allow the pressurized fluid from the main chamber 40 to be communicated to the chamber 50. The pressurized fluid communicated to chamber 50 causes it to be pressurized to the same pressure as the main chamber 40 thereby allowing the secondary piston 48 to move toward the main piston 38 under the force of the biasing spring 49. The secondary piston 48 follows the main piston 38 until the door 18 is opened to the desired position. The pressure in the chamber 50 along with the force of the bising spring 49 have thereby caused the secondary piston 48 to extend and thereby abut the main piston 38 to provide a counterbalancing force to the spring assembly 42. Thus when the door 18 is released the door closer 12 remains in equilibrium with the door 18 open and the counterbalancing assembly extended, as in FIG. 3. The fluid displaced from the diminished volume spring chamber 44 is now trapped in the increased volume of chamber 50 and is prevented from returning to the spring chamber 44 by check valves 62 and 95 thus preventing the closing of the door.

The door 18 may be manually closed by exerting a closing force thereon sufficient to overcome the holding force of the sealing valve 53. When a force is applied to the door to force the door closed the pressure in chamber 50 rises which increases the fluid pressure acting on valve member 82 to bias valve member 82 toward its closed position and which increases the fuid pressure acting on valve 100 which biases the valve member 100 toward its open position. When a predetermined pressure is established in chamber 50 the biasing force of spring 102 will be overcome and valve 100 will open. When this holding force of spring 102 is overcome the door 18 is shut automatically by the force of the spring 42. Under manual exertion of force on door 18, the main piston 38, which is coupled to the door 18, forces the secondary piston 48 back into the secondary piston assembly 46 thereby causing an increased pressure in the chamber 50. This increased pressure builds up until the sealing valve 53 opens against the holding force of the spring 102, as is best seen in FIG. 4. Once the sealing valve 53 is forced open, the action of the spring 42 forces fluid from the chamber 50 by way of the passageways 104,86,54,89,88 and 32 to the main fluid chamber 40 through the porting 32. The main fluid chamber 40 communicates with the spring chamber 44 via the check valve 39 to evacuate fluid back to the spring chamber 44 from the main fluid chamber 40 to allow automatic closing of the door 18.

The door 18 will also automatically close in response to a predetermined condition such as the detection of the products of combustion by the detector 14 or the pressing of the current interruption switch 16. Clearly, the switch 16 can be manual or automatic in its response to conditions such as fire, burglary, unauthorized passage of personnel, etc. Either condition will provide a control signal along either lines 70 or 72 to deactivate the solenoid 56 by preventing a power signal from reaching the solenoid 56 along lines 74. De-energization of the solenoid 56 will allow the sealing valve 52 to be biased by spring 102 from its position blocking the passage 84 to allow the pressurized fluid in the chamber 50 to be exhausted through passageways 96,84,86,54,89,88 and 32 to the main chamber 40 and therefrom to the spring chamber 44 as was discussed earlier. As the fluid is exhausted, the counterbalancing force of the secondary piston diminishes allowing the restoring force of the spring assembly 42 to move the main piston 38 and secondary piston 48 back to its FIG. 2 closed door position. The movement of the main piston 38 forces the secondary piston 48 to retract and the fluid to be exhausted from the chamber 50 to the spring chamber 44 through the adustable valves 37 and 39. The speed with which such fluid movement occurs will determine the speed of the door closing. To vary this speed the valves 37 and 39 are made to be adjustable and offer a variable restriction in the passageway 32 to vary the flow of fluid from the chamber 50 to the main chamber 40 and thereby vary the speed of automatic door 18 closing.

It should be appreciated that the solenoid control valve means 52 is the main valve for controlling fluid flow from the fluid chamber 50 while the valve means 53 comprises a secondary or release valve to allow the fluid to flow from the chamber 50 and the door to close when a predetermined pressure is established in the chamber 50 by forcing the door 18 toward its closed position. When the door 18 is forced toward its closed position the valve means 52 will move to its open position while the solenoid controlled valve means 53 will remain closed. If the solenoid 56 is energized the solenoid force will hold the valve means 52 in its closed position. If the solenoid is not energized and a predetermined pressure is established in chamber 50 the pressure will act on the rear surface 92 of the valve member 82 to hold valve 52 in its closed position. However, the predetermined pressure in chamber 50 will cause the valve member 100 of the valve means 52 to open. Thus, it should be apparent that when the predetermined pressure is established in chamber 50 the net biasing force acting on valve member 82 will be sufficient to hold valve member 82 in its closed position whether the solenoid 56 is energized or de-energized. The net biasing force on valve member 82 will come from the force of the solenoid and the fluid pressure in chamber 50 which direct the valve member 82 toward its closed position and the spring force from spring 90 acting to bias valve member 82 toward its open position. The net biasing force acting to close valve 82 when the solenoid is energized is less than the net biasing force acting to close valve member 100.

An advantage associated with the present construction is that the fluid pressure in chamber 50 acts to bias valve member 82 toward its closed position. If the solenoid 56 is momentarily de-energized, such as might result in an electrical storm, the valve member 82 will move to its open position to allow the door to start to close. However, if the solenoid is subsequently re-energized prior to the door reaching its fully closed position, the solenoid will again move the valve member 82 to its closed position blocking the fluid passageway 84 and stopping movement of the door. This is in constrast to door closer assemblies illustrated in the prior art, such as in the Slaybaugh U.S. Pat. No. 3,852,846, wherein the fluid pressure acts to hold the solenoid controlled valve member 82 in its open position due to the fact that the fluid pressure in the hold open chamber acts to open rather than close the solenoid controlled valve. Re-energization of the solenoid 56 in the present invention allows valve member 82 to close due to the fact that the fluid pressure is not acting against valve member 82 to prevent valve member 82 from closing. Rather, in the present instance the fluid pressure actually biases the valve member 82 toward its closed position.

For the foregoing it will be seen that a unique door closing system is provided which will maintain a door in the last open position until the occurrence of some emergency situation when the door will be automatically closed. Clearly those skilled in the art will see that certain modifications and improvements may be made to this system. It will be understood that such were deleted for the sake of conciseness and readability but are within the scope of the present invention.

I claim:

1. A door closer hold open assembly connectable to a door for closing the door in response to a control signal comprising, a housing, a linkage assembly connectable to the door to transmit door movement from a closed position to an open position, biasing means providing a restoring force to move the door to the closed position, a main piston assembly disposed in said housing and actuatable by said linkage assembly to move said main piston assembly against the force of said biasing means as the door moves from said closed position, a fluid chamber disposed in said housing and having fluid disposed therein for exerting a force on said main piston to balance the force of said biasing means in any desired door position to maintain said main piston in the position it was last moved to by said linkage assembly, and release means for releasing the fluid disposed in said chamber to dissipate the balancing force of said fluid to allow the door to return to the closed position, said release means including first and second valve means disposed in a parallel circuit each of which is independently operable to control the flow of fluid from said chamber, said first valve means being electrically controlled from a closed position prohibiting flow therethrough from said chamber to an open position providing flow therethrough from said chamber, said second valve means being resiliently biased toward a closed position prohibiting fluid flow therethrough from said chamber and being operable upon a predetermined increase in the fluid pressure in said chamber to open against said resilient biasing force and provide for fluid flow therethrough from said chamber.

2. A door closer hold open assembly as defined in claim 1 wherein said fluid in said chamber exerts a force on said first valve means when said first valve means is in said closed position to bias said first valve means towards said closed position.

3. A door closer hold open assembly as defined in claim 1 wherein said first valve means includes a first valve member, a solenoid energizable for biasing said first valve member toward said closed position and second biasing means for biasing said second valve member toward the closed position preventing fluid flow from said chamber and said fluid in said chamber exerts a force on said first valve member when said first valve member is in said closed position to bias said first valve member towards said closed position.

4. A door closer hold open assembly as defined in claim 3 wherein de-energization of said solenoid is operable to allow said second biasing means to overcome the fluid pressure in said chamber acting to bias said first valve member toward said closed position to effect movement of said first valve member to said open position.

5. A door closer hold open assembly as defined in claim 3 wherein a momentary de-energization of said solenoid is operable to allow said second biasing means to overcome the fluid pressure in said chamber to effect movement of said first valve member to said open position to enable said door to close under the force of said biasing means and wherein subsequent re-energization of said solenoid prior to the door moving to its closed position effects movement of said first valve member to said closed position against the biasing force of said second biasing means to again stop movement of said main piston assembly and said door.

6. A door closer hold open assembly as defined in claim 1 wherein said second valve means includes a second valve member and third biasing means for biasing said second valve member toward said closed position preventing fluid flow therethrough from said chamber.

7. A door closer hold open assembly as defined in claim 3 wherein said second valve means includes a second valve member and third biasing means for biasing said second valve member toward said closed position preventing fluid flow therethrough from said chamber.

8. A door closer hold open assembly as defined in claim 7 wherein de-energization of said solenoid is operable to allow said second biasing means to overcome the fluid pressure in each chamber to effect movement of said first valve member to said open position to enable said door to close under the force of said biasing means and wherein subsequent re-energization of said solenoid prior to the door moving to its closed position effects movement of said first valve member to said closed position against the biasing force of said second biasing means to again stop movement of said main piston assembly and said door.

9. A door closer hold open assembly as defined in claim 7 wherein the biasing force exerted on said second valve member by said third biasing means is less than the biasing force exerted by said solenoid to bias said first valve member toward said closed position and the biasing force exerted by said fluid in said chamber to bias said first valve member toward said closed position to enable said second valve member to move to its open position while said first valve member is in said closed position upon the fluid pressure in said chamber increasing to a predetermined value.

10. A door closer hold open assembly as defined in claim 7 wherein the biasing force exerted on said second valve member by said third biasing means is less than the net biasing force exerted on said first valve member to bias said first valve member to said closed position, said net biasing force being the net sum of the force exerted by the solenoid on said first valve member directing said first valve member toward said closed position, a force acting on said first valve member by said fluid pressure in said chamber directing said first valve member toward said closed position and the force exerted by said second biasing means on said first valve member directing said first valve member toward said open position, to enable said second valve member to open while said solenoid is energized and said first valve member is in said closed position upon the fluid pressure in said chamber increasing to a predetermined value.

11. A door closer hold open assembly as defined in claim 7 wherein the biasing force exerted on said second valve member by said third biasing means is less than the net biasing force directing said first valve member toward said closed position from said second biasing means and said fluid pressure in said chamber when said solenoid is de-energized and the pressure in said chamber reaches said predetermined pressure to enable movement of said second valve member towards said open position in response to the fluid pressure acting thereon.

12. A door closer hold open assembly as defined in claim 1 further including a main piston chamber located in said body and having fluid therein for controlling the movement of said main piston assembly, said first and second valve means controlling the flow of fluid from said fluid chamber to said main piston chamber.

13. A door closer hold open assembly as defined in claim 7 further including a main piston chamber located in said body and having fluid therein for controlling the movement of said main piston assembly, said first and second valve means controlling the fluid flow from said fluid chamber to said main piston chamber.

14. A door closer hold open assembly as defined in claim 7 wherein the biasing forces acting on said first and second valve members enables said second valve member to move to said open position while said first valve member remains in said closed position upon the fluid pressure in said chamber reaching a predetermined value.

15. A door closer hold open assembly connectable to a door for closing the door in response to a control signal comprising, a housing, a linkage assembly connected to the door to transmit door movement from a closed position to an open position, biasing means providing a restoring force to move said door to the closed position, a main piston assembly disposed in said housing and actuatable by said linkage assembly to move said main piston assembly against the force of said biasing means as the door moves from said closed position, a fluid chamber disposed in said housing and having fluid disposed therein for exerting a force on said main piston to balance the force of said biasing means in a desired door position to maintain said main piston in the position it was last moved to by said linkage assembly, and release means for releasing the fluid disposed in said chamber to dissipate the balancing force of said fluid to allow the door to return to the closed position under the influence of said biasing means, said release means including an electrically controlled valve means which is operable to control the flow of fluid from said chamber, said valve means including a first valve member, a solenoid energizable for biasing said first valve member toward a closed position preventing fluid flow therethrough from said chamber and second biasing means for biasing said first valve member toward an open position to provide fluid flow therethrough from said chamber, said fluid in said chamber exerting a force on said first valve member when said first valve member is in said closed position to bias said first valve member toward said closed position.

16. A door closer hold open assembly as defined in claim 15 wherein de-energization of said solenoid is operable to allow said second biasing means to overcome the fluid pressure in said chamber acting to bias said first valve member toward said closed position to effect movement of said first valve member to said open position.

17. A door closer hold open assembly as defined in claim 15 wherein a momentary de-energization of said solenoid is operable to allow said second biasing means to overcome the fluid pressure in said chamber to effect movement of said first valve member to said open position to enable said door to close under the force of said biasing means and wherein subsequent re-energization of said solenoid prior to the door moving to its closed position effects movement of said first valve member to said closed position against the biasing force of said second biasing means to again stop movement of said main piston assembly and said door.

18. A door closer hold open assembly as defined in claim 15 wherein said release means further includes second valve means disposed in a parallel circuit to said first valve means to control the flow of fluid from said chamber, said second valve means including a second valve member and third biasing means for biasing said second valve member toward a closed position preventing fluid flow therethrough from said chamber, said fluid in said chamber exerting a force on said second valve member to bias said second valve member toward said open position.

19. A door closer hold open assembly as defined in claim 18 wherein the biasing forces acting on said first and second valve members enables said second valve member to move to said open position while said first valve member remains in said closed position upon the fluid pressure in said chamber reaching a predetermined value.

20. A door closer hold open assembly as defined in claim 18 wherein the biasing force exerted on said second valve member by said third biasing means is less than the net biasing force exerted on said first valve member to bias said first valve member toward said closed position, said net biasing force being the net sum of the force exerted by said solenoid on said first valve member directing said first valve member toward said closed position, the force acting on said first valve member by said fluid pressure in said chamber directing said first valve member toward said closed position and the force exerted by said second biasing means on said first valve member directing said first valve member toward said open position, to thereby enable said second valve member to open while said solenoid is energized and said first valve member is in said closed position upon said fluid pressure in said chamber increasing to a predetermined value.

21. A door closer hold open assembly as defined in claim 18 wherein the biasing force exerted on said second valve member by said third biasing means is less than the net biasing force directing said first valve member toward said closed position when said solenoid is de-energized to enable said second valve member to move toward said open position when the pressure in said chamber reaches a predetermined pressure and said first valve means is in said closed position.

22. A door closer hold open assembly as defined in claim 15 further including a main piston chamber located in said body and having fluid therein for controlling the movement of said main piston assembly, said first valve member controlling the fluid flow from said fluid chamber to said main piston chamber.

23. A door closer hold open assembly as defined in claim 18 further including a main piston chamber located in said body and having fluid therein for controlling movement of said main piston assembly, said first and second valve members controlling the fluid flow from said fluid chamber to said main piston chamber.

* * * * *

UNITED STATES PATENT AND TRADEMARK OFFICE

CERTIFICATE OF CORRECTION

PATENT NO. : 4,050,114
DATED : September 27, 1977
INVENTOR(S) : Richard L Zunkel It is certified that error appears in the above-identified patent and that said Letters Patent are hereby corrected as shown below:

| | |
|---|---|
| Col. 4, line 28: | "withn" should read "within". |
| line 53: | "hs" should read "has". |
| Col. 5, line 37: | "bising" should read "biasing". |
| line 27: | "oepn" should read "open". |
| line 54: | "fuid" should read "fluid". |
| Col. 6, line 31: | "adustable" should read "adjustable". |
| Col. 7, line 24: | "For" should read "From". |
| Col. 8, line 51: | "each" should read "said". |

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*